US008437648B2

(12) United States Patent
Tachibana

(10) Patent No.: US 8,437,648 B2
(45) Date of Patent: May 7, 2013

(54) IMAGE FORMING APPARATUS AND METHOD THEREOF

(75) Inventor: Yoshiro Tachibana, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 277 days.

(21) Appl. No.: 12/822,029

(22) Filed: Jun. 23, 2010

(65) Prior Publication Data

US 2010/0329704 A1 Dec. 30, 2010

(30) Foreign Application Priority Data

Jun. 29, 2009 (JP) ..... 2009-153320

(51) Int. Cl.
*G03G 15/08* (2006.01)

(52) U.S. Cl.
USPC ..... 399/27; 399/13; 399/18; 399/24; 399/61; 399/262

(58) Field of Classification Search ..... 399/13, 399/18, 24, 61, 81
See application file for complete search history.

(56) References Cited

U.S. PATENT DOCUMENTS

| | | | | |
|---|---|---|---|---|
| 3,514,202 | A * | 5/1970 | Mau et al. | 399/220 |
| 4,435,074 | A * | 3/1984 | Midorikawa et al. | 399/346 |
| 5,610,692 | A * | 3/1997 | Trask et al. | 399/27 |
| 5,887,217 | A * | 3/1999 | Mitekura et al. | 399/13 |
| 6,029,018 | A * | 2/2000 | Rogers et al. | 399/12 |
| 7,010,243 | B2 * | 3/2006 | Shimada | 399/111 |
| 7,095,965 | B2 | 8/2006 | Hamano et al. | |
| 2002/0094210 | A1 * | 7/2002 | Fischer | 399/27 |
| 2004/0223774 | A1 * | 11/2004 | Shimada | 399/27 |
| 2004/0234282 | A1 * | 11/2004 | Hamano et al. | 399/27 |
| 2007/0217798 | A1 * | 9/2007 | Tsuji et al. | 399/27 |
| 2009/0297172 | A1 * | 12/2009 | Kaji | 399/13 |
| 2010/0272473 | A1 * | 10/2010 | Yoshii | 399/254 |
| 2012/0019861 | A1 * | 1/2012 | Okada et al. | 358/1.15 |

FOREIGN PATENT DOCUMENTS

| | | | |
|---|---|---|---|
| JP | 01052173 | A * | 2/1989 |
| JP | 2003076098 | A * | 3/2003 |
| JP | 2004151209 | A * | 5/2004 |
| JP | 2004-271956 | A | 9/2004 |

* cited by examiner

*Primary Examiner* — David Gray
*Assistant Examiner* — Francis Gray
(74) *Attorney, Agent, or Firm* — Canon USA, Inc., IP Division

(57) ABSTRACT

An image forming apparatus is configured to give an instruction for unlocking of a cover corresponding to a toner container, from a replacement screen of the toner container displayed when no toner inside the toner container is detected. Further, the image forming apparatus is configured such that the cover corresponding to at least one toner container can be unlocked at a time from the displayed screen.

11 Claims, 17 Drawing Sheets

IMAGE FORMING APPARATUS AND METHOD THEREOF

BACKGROUND OF THE INVENTION

1. Field of the Invention

The present invention relates to an image forming apparatus such as a printer, copying machine, and facsimile, and in particular, relates to an image forming apparatus using a removable toner container and capable of replacing toner.

2. Description of the Related Art

In an image forming apparatus such as a printer, copying machine, and facsimile, an image is formed by an electrophotography system, offset printing system, inkjet printing system or the like. In addition, as an example of such an image forming apparatus, an image forming apparatus capable of forming a color image by the electrophotography system has been known. Mainly from a structure viewpoint, such an image forming apparatus has an image formation part including a plurality of image formation units and is classified into either a tandem system in which the plurality of image formation units is arranged in a line or a rotary system in which the plurality of image formation units is arranged in a cylindrical shape. Also, the transfer methods are classified into a direct transfer method by which a toner image is directly transferred from a photosensitive member to a sheet and an intermediate transfer method by which a toner image is temporarily transferred to an intermediate transfer member before being transferred to a sheet. The intermediate transfer tandem system in which a plurality (four) of image formation units is arranged on an intermediate transfer belt need not hold, like the direct transfer method, sheets on a transfer drum or transfer belt. Thus, the intermediate transfer tandem system has an advantage from the viewpoint of capability of dealing with various kinds of sheets such as a super-cardboard and coat paper. Further, a paper path up to a secondary transfer unit can be simply structured and the stretching method of the intermediate transfer belt is highly flexible. Therefore, the intermediate transfer tandem system has also an advantage in miniaturization of the image forming apparatus.

On the other hand, in consideration of the environment problem, various techniques have been discussed to use up toner in a toner container in an image forming apparatus (see, for example, Japanese Patent Application Laid-Open No. 2004-271956). Japanese Patent Application Laid-Open No. 2004-271956 discusses an image forming apparatus that detects the remaining amount of toner in a plurality of toner containers containing toner and moves a toner container found to be substantially out of toner to a replacement position by a movable member, which makes the toner container replaceable. Moreover, the image forming apparatus is configured such that if there is a plurality of toner containers found to be out of toner, the toner container that is to be preferentially moved to the replacement position is selected.

However, further improvements are desired regarding the conventional technique described above. More specifically, the toner container at the replacement position can be extracted at any moment and if a toner container that is not used up is at the replacement position, the toner container has been freely replaced. Moreover, only the toner container at the replacement position can be replaced. Therefore, if there is a plurality of toner containers found to be out of toner, an operation to move another toner container to the replacement position has been necessary.

SUMMARY OF THE INVENTION

The present invention is directed to providing a mechanism which uses up toner in a toner container and is highly user-friendly when the toner container is replaced.

According to an aspect of the present invention, an image forming apparatus from which a toner container is detachable, including a development device to which toner in the detachable toner container is fed and in which the toner used for image formation is accumulated, and a display, includes a locking unit configured to lock a cover of the toner container so that the mounted toner container is not extracted, a detection unit configured to detect that there is no toner in the mounted toner container, and a display unit configured, when the detection unit detects that there is no toner, to cause the display to display a screen to receive input for replacing the toner container in which no toner is detected, wherein the locking unit unlocks the cover of the toner container in response to the input received via the screen displayed by the display unit to make replaceable the toner container in which no toner is detected.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Figure 1:
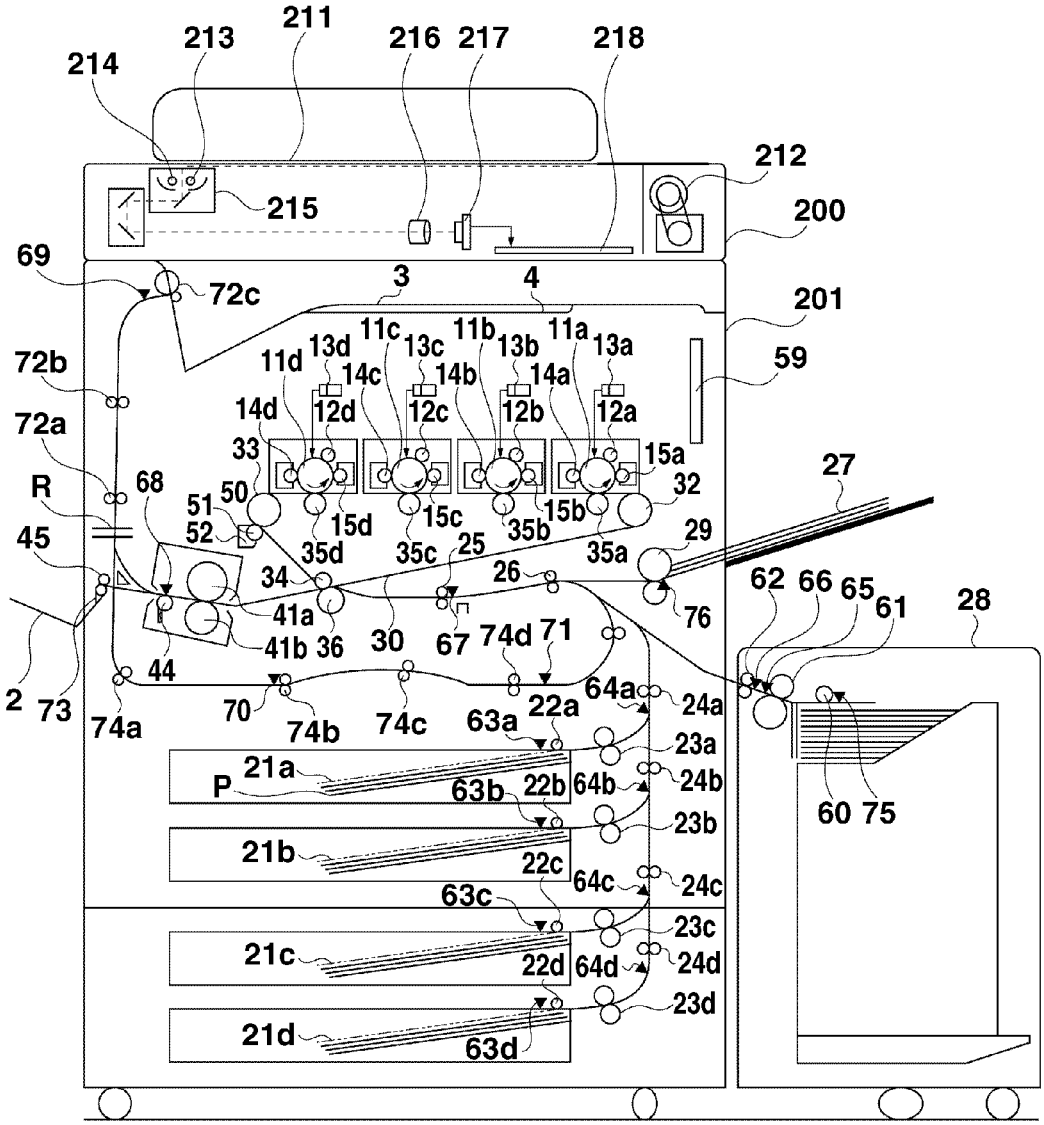
FIG. 1 is a sectional view illustrating an outline configuration of a full-color copying machine, which is an example of an image forming apparatus according to an exemplary embodiment.

FIG. 1 is a sectional view illustrating an outline configuration of a full-color copying machine, which is an example of an image forming apparatus. As illustrated in FIG. 1, the full-color copying machine includes a digital color image reader unit 200 (hereinafter, referred to as a reader unit) and a digital color image printer unit 201 (hereinafter, referred to as a printer unit).

In the reader unit 200, a document is placed on document positioning glass 211 to perform exposure and scanning with a document scanning unit 215. The document scanning unit 215 includes exposure lamps 213 and 214 and is driven by an optical system reading drive motor 212 at a fixed speed. Then, a reflected light image from the document is condensed into a full-color sensor (charge-coupled device (CCD)) 217 by a lens 216 to obtain color-separation image signals. A 3-line CCD with R (red), G (green), and B (blue) filters arranged adjacent to each other is used as the full-color sensor 217. The color-separation image signals are sent out to the printer unit 201 after image processing is performed thereon by an image processing unit 218. An operation unit is provided around the perimeter of the document positioning glass 211 in which hardware keys to set various modes concerning copying sequences, a display, and an indicator are arranged.

Next, the printer unit 201 will be described. A control unit 59 is a controller, which includes a controller board having a central processing unit (CPU), a random access memory (RAM), and a read-only memory (ROM). The control unit 59 collectively controls operations of a feeding unit, an intermediate transfer unit, a conveyance unit, a fixing unit, and the operation unit based on a control program stored in the ROM. The image formation part that forms an image under the control of the control unit 59 has a configuration as described below.

Photosensitive drums 11*a*, 11*b*, 11*c*, and 11*d* as image carriers are pivotally supported in the center thereof and are driven to rotate by a drive motor (not illustrated) in an arrow direction. Roller chargers 12*a*, 12*b*, 12*c*, and 12*d*, scanners 13*a*, 13*b*, 13*c*, and 13*d*, development devices 14*a*, 14*b*, 14*c*, and 14*d*, and photosensitive drum cleaning devices 15*a*, 15*b*, 15*c*, and 15*d* are arranged opposite to an outer circumferential surface of the photosensitive drums 11*a* to 11*d* in the direction of rotation thereof. In such a configuration, the roller chargers 12*a* to 12*d* provide a uniform electrification amount of charges to the surface of the photosensitive drums 11*a* to 11*d*.

Next, the photosensitive drums 11*a* to 11*d* are exposed to a light beam such as a laser beam modulated according to a recorded image signal by the scanners 13*a* to 13*d* to form an electrostatic latent image there. Further, the electrostatic latent image is developed by the development devices 14*a* to 14*d*, each containing toner of four colors such as black, cyan, magenta, and yellow. The developed visible image is transferred to an intermediate transfer member 30. Then, toner remaining on the photosensitive drums 11*a* to 11*d* is collected by the photosensitive drum cleaning devices 15*a* to 15*d*. With the above processes, image formation by each toner is successively carried out.

The feeding unit includes a part to store a recording material P, a roller to convey the recording material P, a sensor to detect passage of the recording material P, a sensor to detect presence/absence of the recording material P, and a guide (not illustrated) for conveyance of the recording material P along a conveyance path.

Cassettes 21*a*, 21*b*, 21*c*, and 21*d*, an attachable/detachable tray 27, and a deck 28 contain the recording material P. Pickup rollers 22*a*, 22*b*, 22*c*, and 22*d* feed the recording material P from the cassettes 21*a* to 21*d* one by one from above. A plurality of sheets of the recording material P may be fed by the pickup rollers 22*a* to 22*d*, but then one sheet is reliably separated by BC rollers 23*a* to 23*d*. One sheet of the recording material P separated o by the BC rollers 23*a* to 23*d* is further conveyed to a registration roller 25 by extraction rollers 24*a*, 24*b*, 24*c*, and 24*d* and a pre-registration roller 26.

One sheet of the recording material P contained in the detachable tray 27 is separated by a BC roller 29 and conveyed to the registration roller 25 by the pre-registration roller 26. A plurality of sheets of the recording material P contained in the deck 28 is conveyed to a feeding roller 61 by a pickup roller 60 and one sheet is reliably separated by the feeding roller 61 before conveyance to an extraction roller 62. Further, the recording material P is conveyed to the registration roller 25 by the pre-registration roller 26.

A fixing unit 40 includes a fixing roller 41*a* having a heat source such as a halogen heater inside, a roller 41*b* (this roller may also have a heat source) pressed by the roller 41*a*, and an internal paper ejecting roller 44 that conveys the recording material P ejected by the pair of rollers.

On the other hand, the recording material P conveyed up to the registration roller 25 is temporarily stopped by stopping the rotation of the roller upstream of the registration roller 25. The rotation of the upstream roller including the registration roller 25 is restarted at the timing coinciding with image formation by the image formation part. The recording material P is sent out to a secondary transfer area described below.

The image is transferred in the secondary transfer area onto the recording material P on which the image is fixed by the fixing unit 40. After the recording material P passes through the internal paper ejecting roller 44, the conveyance destination is switched by a switching flapper 73. If the switching flapper 73 is positioned on a face-up delivery side, the recording material P is ejected to a face-up delivery tray 2 by an outer delivery roller 45. On the other hand, if the switching flapper 73 is positioned on a face-down delivery side, the recording material P is conveyed in a direction of reversal rollers 72*a*, 72*b*, and 72*c* to be ejected to a face-down delivery tray 3.

A plurality of sensors is arranged along the conveyance path of the recording material P to detect passage of the recording material P. These sensors include, for example, feeding retry sensors 64*a*, 64*b*, 64*c*, and 64*d*, a deck feeding sensor 65, a deck extraction sensor 66, a registration sensor 67, an internal delivery sensor 68, a face-down delivery sensor 69, a double-sided pre-registration sensor 70, and a double-sided re-feeding sensor 71. In the cassettes 21*a* to 21*d* containing the recording material P, cassette paper presence/absence sensors 63*a*, 63*b*, 63*c*, and 63*d* to detect presence/absence of the recording material P are arranged. A manual feed tray paper presence/absence sensor 74 to detect presence/absence of the recording material P on the manual feed tray 27 is arranged on the manual feed tray 27. A deck paper presence/absence sensor 75 to detect presence/absence of the recording material P inside the deck 28 is arranged on the deck 28.

Figure 2:
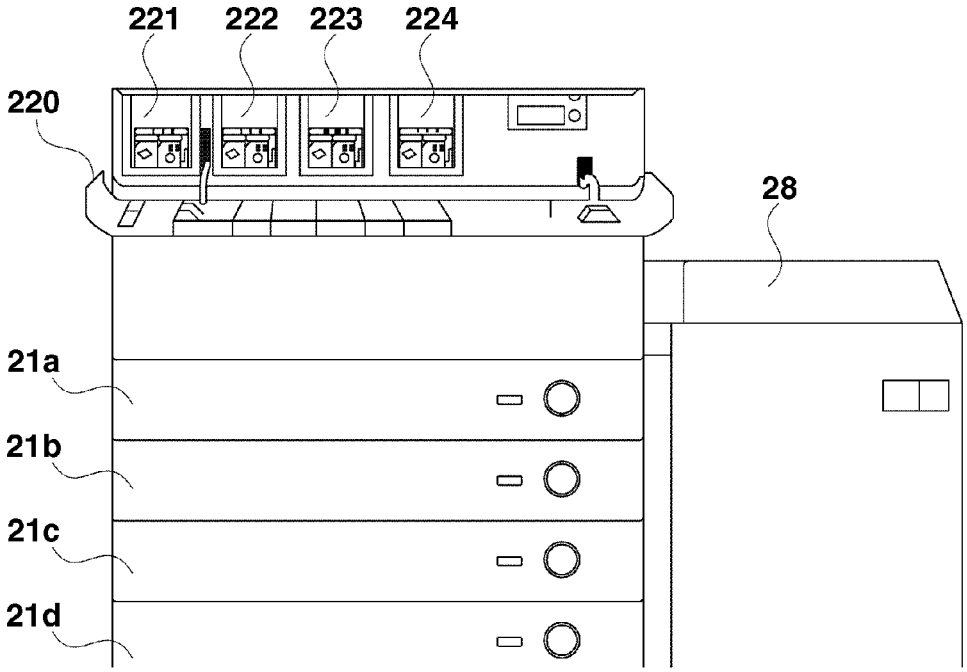
FIG. 2 is an external view when a toner replacement cover of the full-color copying machine, which is an example of the image forming apparatus according to the exemplary embodiment, is opened.

FIG. 2 is an external view when a toner replacement cover of a full-color copying machine, which is an example of the image forming apparatus, is opened. The full-color copying machine has double-entry doors, i.e., a toner replacement cover 220 and toner bottle covers 221, 222, 223, and 224. Further, the full-color copying machine is configured such that when the toner replacement cover 220 is closed, the toner bottle covers 221 to 224 are also closed simultaneously. Further, the full-color copying machine has an opening/closing detection sensor of the toner replacement cover to detect whether the toner replacement cover 220 is opened.

Figure 3:
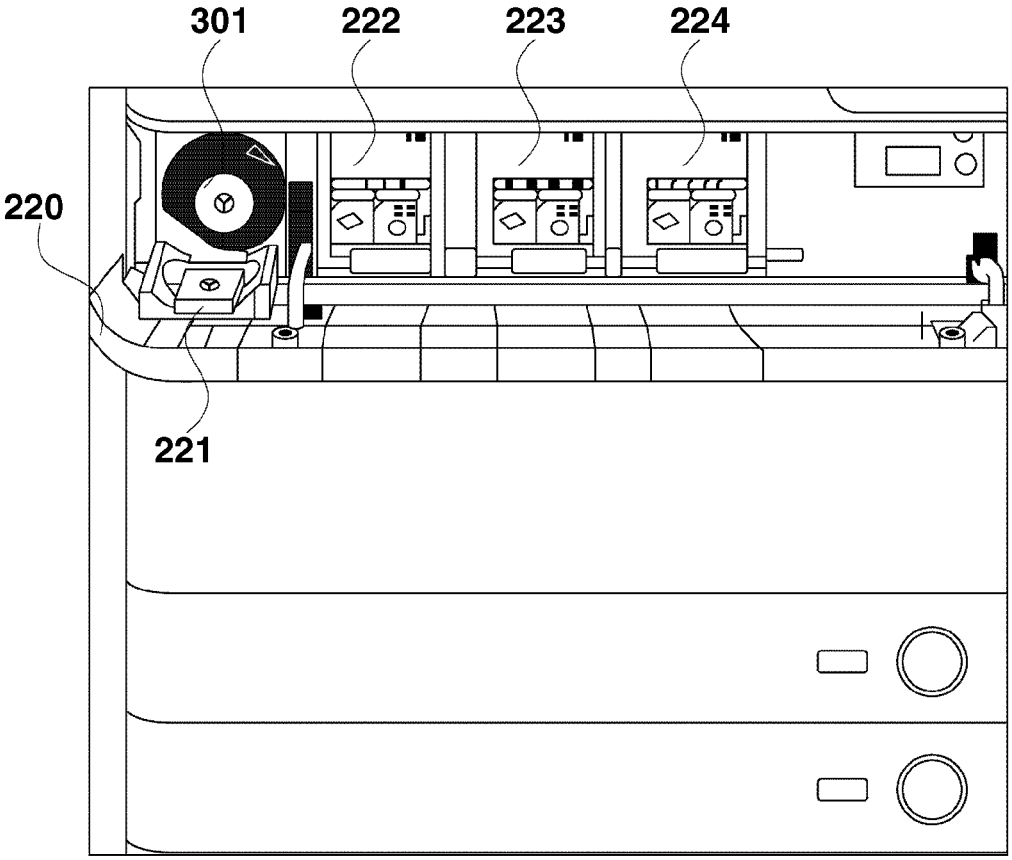
FIG. 3 is an external view when a toner bottle cover of the full-color copying machine, which is an example of the image forming apparatus according to the exemplary embodiment, is opened.

FIG. 3 is an external view when a toner bottle cover of the full-color copying machine, which is an example of the image forming apparatus, is opened. If the toner bottle cover 221 is opened, a toner bottle 301 is found inside. Similarly, if the toner bottle covers 222 to 224 are opened, toner bottles (not illustrated) containing toner of mutually different colors are found inside. Since the four toner bottles are all similarly configured, the toner bottle 301 will be used for the description below. The toner bottle 301 contains toner therein and when an electrostatic latent image is developed, toner is fed from the toner bottle 301 with a high voltage applied to the development machine 14*d* so that the electrostatic latent image on the photosensitive drums 11*d* is developed. When the toner bottle cover 221 is opened in a direction of an apparatus front, the toner bottle 301 therein is slightly pulled out simultaneously. In this state where toner bottle 301 is slightly pulled out, no toner will be fed from the toner bottle 301.

Figure 4:
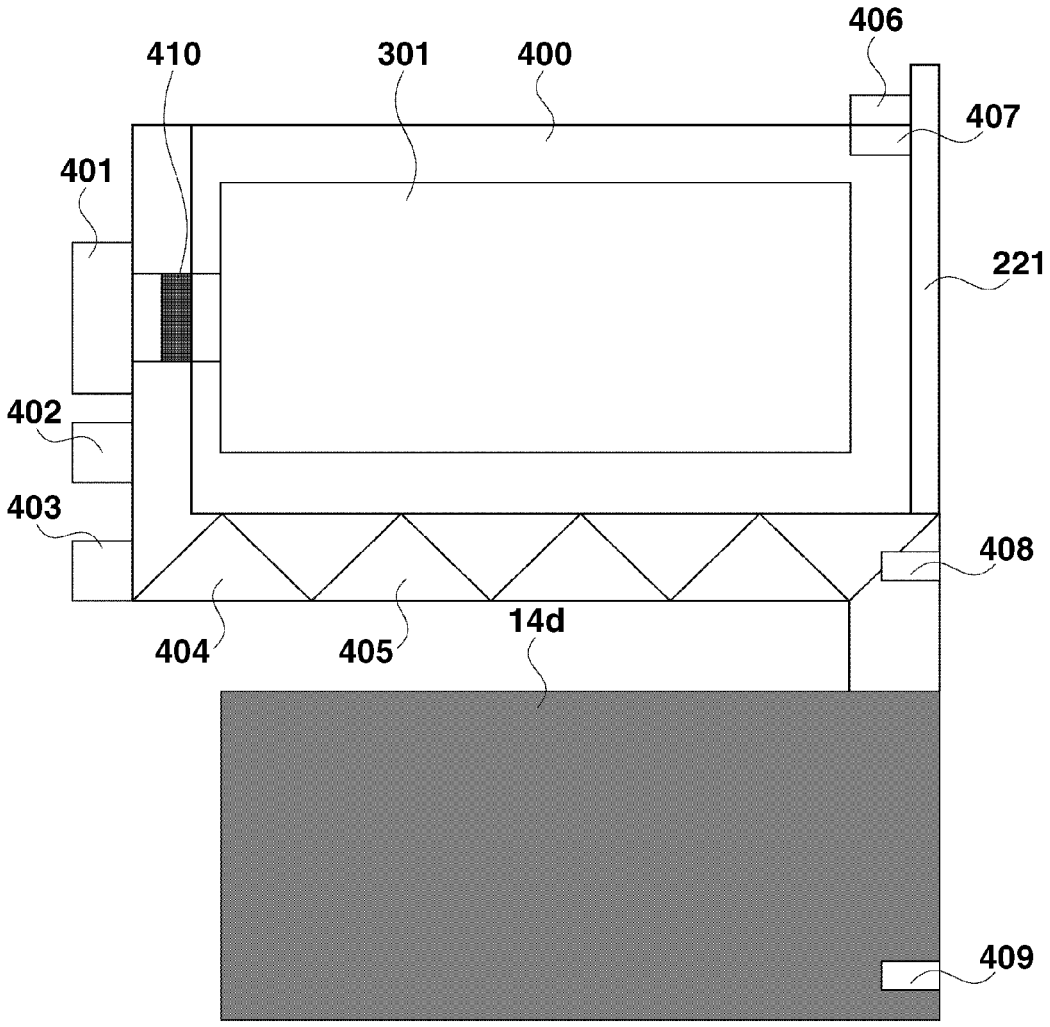
FIG. 4 is a sectional view illustrating a relative physical relationship between a development device and a toner bottle according to the exemplary embodiment in a simplified manner.

FIG. 4 is a sectional view illustrating a relative physical relationship between a development device and a toner bottle in the image forming apparatus in a simplified manner. Since the development devices 14*a* to 14*d* are all similarly configured, the development device 14*d* will be used for the description below. Here, the toner bottle is a toner container detachable from the image forming apparatus, and development devices and hoppers are installed within the image forming apparatus. The toner bottle is a container in which toner used for image formation is accumulated. Toner is fed to the development devices in the image forming apparatus from the toner bottle mounted on the apparatus.

The development device 14*d* is replenished with toner mainly via a toner bottle insertion chamber 400 and a hopper 404. The toner bottle 301 inserted into the toner bottle insertion chamber 400 is in a position capable of feeding toner. The toner bottle 301 internally has a spiral projection and when the toner bottle 301 is rotated by a toner bottle rotating motor 401, the toner contained therein moves to a toner opening 410. The hopper 404 that receives the toner fed to the toner opening 410 to feed the toner to the development device 14*d* is formed from a pipe-shaped member. By rotating a screw 405, which is a screw-type feeding mechanism inside the hopper 404, with a screw rotating motor 403, toner inside the hopper 404 is fed into the development device 14*d* while being stirred.

The hopper 404 has a hopper internal toner detection sensor 408 which uses a piezo-electric element as a sensor to detect the remaining amount of hopper internal toner inside the hopper 404. If the hopper internal toner detection sensor 408 detects that there is no toner in the hopper 404, it is also possible to detect that there is no toner inside the toner bottle 301. Similarly, a development device internal toner detection sensor 409 to detect the remaining amount of toner is arranged inside the development device 14*d*. In addition, a toner bottle cover opening/closing detection sensor 406 to detect whether the toner bottle cover 221 is opened is arranged. The toner bottle cover 221 is locked by a toner bottle cover solenoid 407 as a locking unit.

If the toner bottle cover solenoid 407 is unlocked, the toner opening 410 inside the toner bottle insertion chamber 400 is closed. At the same time, the toner bottle cover 221 is opened and the toner bottle slides in the direction of the image forming apparatus front in FIG. 3 to move to a position where it is easy to replace toner.

Figure 5:
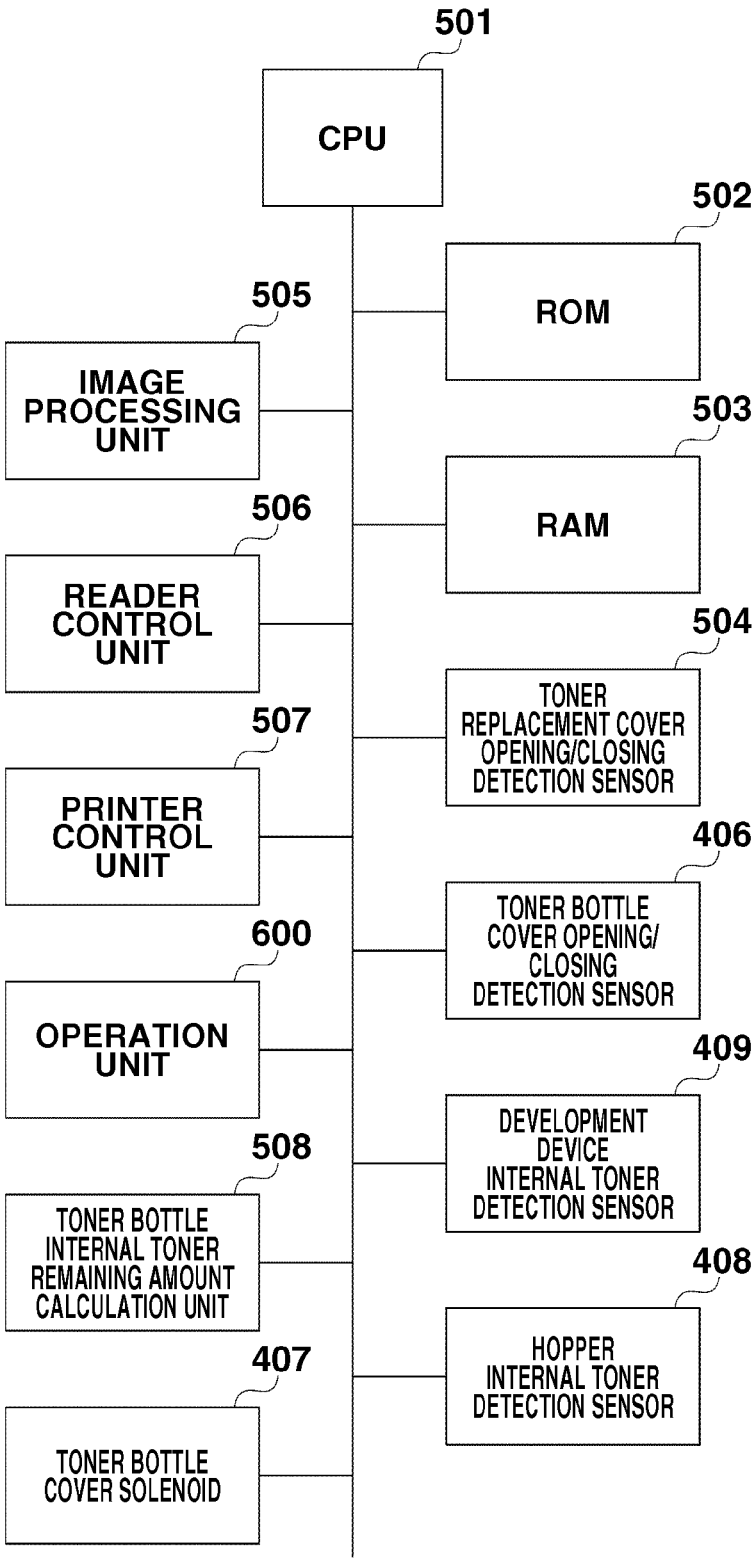
FIG. 5 is a block diagram illustrating the configuration of a control unit according to the exemplary embodiment.

FIG. 5 is a block diagram illustrating the configuration of the control unit 59. A CPU 501 illustrated in FIG. 5 exercises basic control over a full-color copying machine. A ROM 502 into which a control program and control data to realize processing described below are written and a RAM 503 used by the CPU 501 for process execution as a work area are connected to the CPU 501 via an address bus or a data bus.

A reader control unit 506 and a printer control unit 507, which are an electric circuit including an input/output port to control each component of the reader unit 200 and the printer unit 201 respectively, are also connected to the CPU 501. The CPU 501 performs an image formation operation by controlling toner bottle replacement described below or controlling the reader control unit 506 or the printer control unit 507. Further, an image processing unit 505 that performs various kinds of image processing on digital data of a document image converted by the reader control unit 506 is connected to the CPU 501. Also, a toner bottle internal toner remaining amount calculation unit 508 is connected to the CPU 501. The calculation unit 508 calculates the remaining amount of toner inside the toner bottle 301 by calculating a video count value per page of output image and adding up the calculated video count value Further, an operation unit 600 to receive input of a user's operation and to make a display for notification is connected to the CPU 501.

Figure 6:
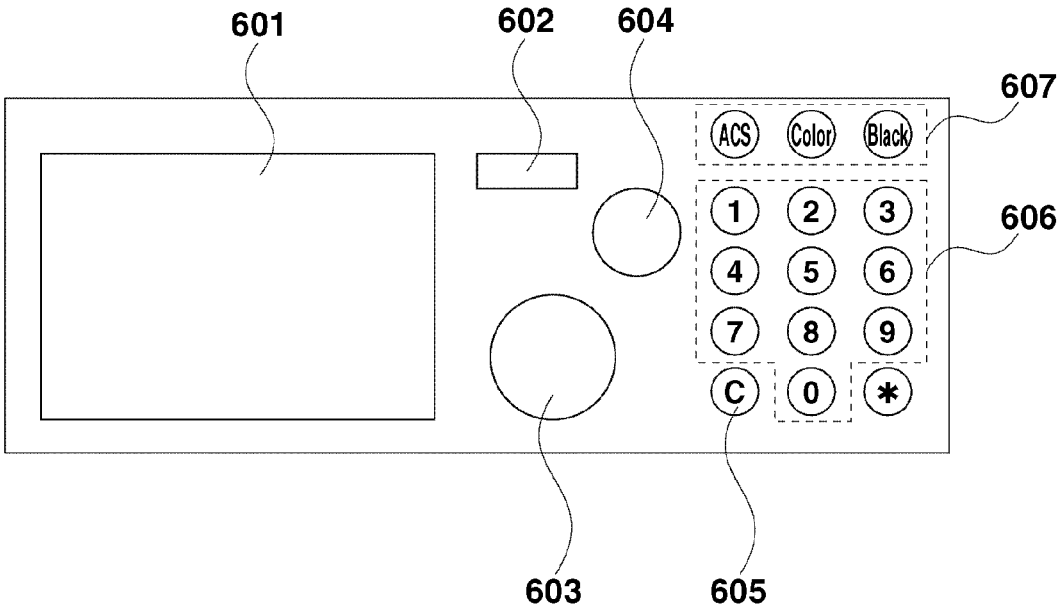
FIG. 6 is a diagram illustrating the configuration of an operation unit according to the exemplary embodiment.
Figure 7:
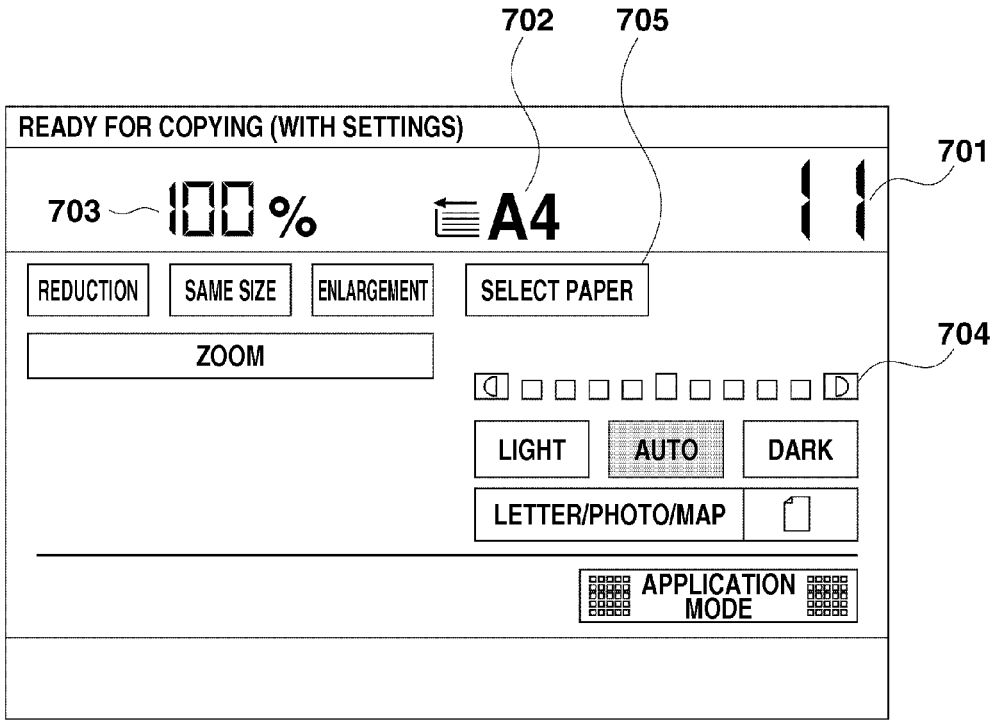
FIG. 7 is a diagram illustrating an example of a copying screen displayed in the operation unit of the exemplary embodiment.

FIG. 6 is a diagram illustrating the configuration of the operation unit 600. In FIG. 6, the operation unit 600 includes a touch-panel display (display) 601. For example, as illustrated in FIG. 7, a number of copies 701, a selected paper size 702, a magnification 703, and a copy density 704 are displayed. The example illustrated in FIG. 7 shows a state in which an A4 size is selected by a paper selection key 705 and the number of copies is set to 11 copies by a ten-keypad described below.

Returning to FIG. 6, a reset key 602 restores functions set by the operation unit 600 to default values. A start key 603 starts a copying operation. A stop key 604 stops the copying operation. A clear key 605 restores the copy mode to the standard mode. A ten-keypad 606 sets the number of copies. A plurality of color mode selection keys 607 include an auto color select (ACS) key that outputs a color image if a color attribute of a document is determined to be a color mode and output a monochrome image if the color attribute is determined to be a monochrome mode. The color mode selection keys 607 also include a color key that outputs a color image regardless of the document, and a black key that outputs a monochrome image regardless of the document. Here, one of three keys is lit.

Figure 8:
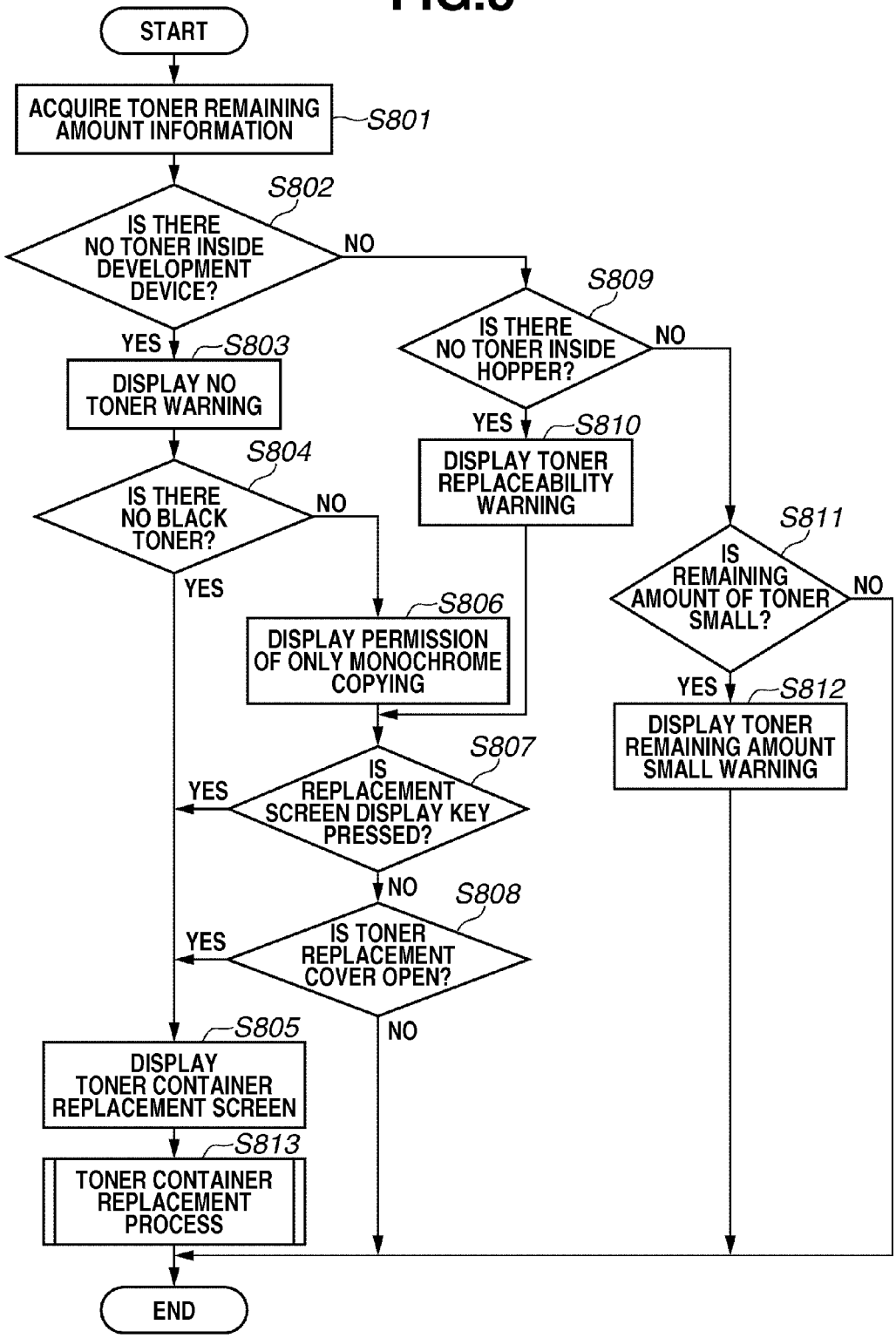
FIG. 8 is a flow chart illustrating a display control procedure for a toner container replacement screen according to the exemplary embodiment.

Next, the display control procedure for the toner container replacement screen will be described using the flow chart in FIG. 8.

Figure 9:
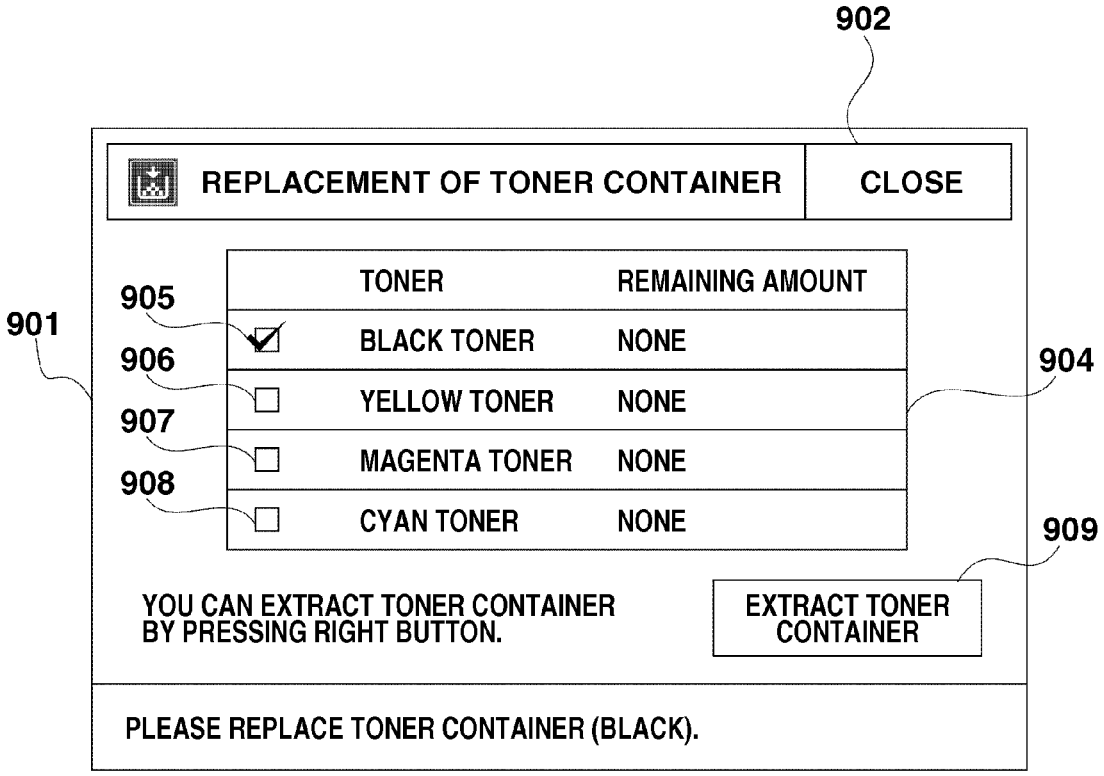
FIG. 9 is a diagram illustrating an example of the toner container replacement screen displayed in the operation unit of the exemplary embodiment.
Figure 10:
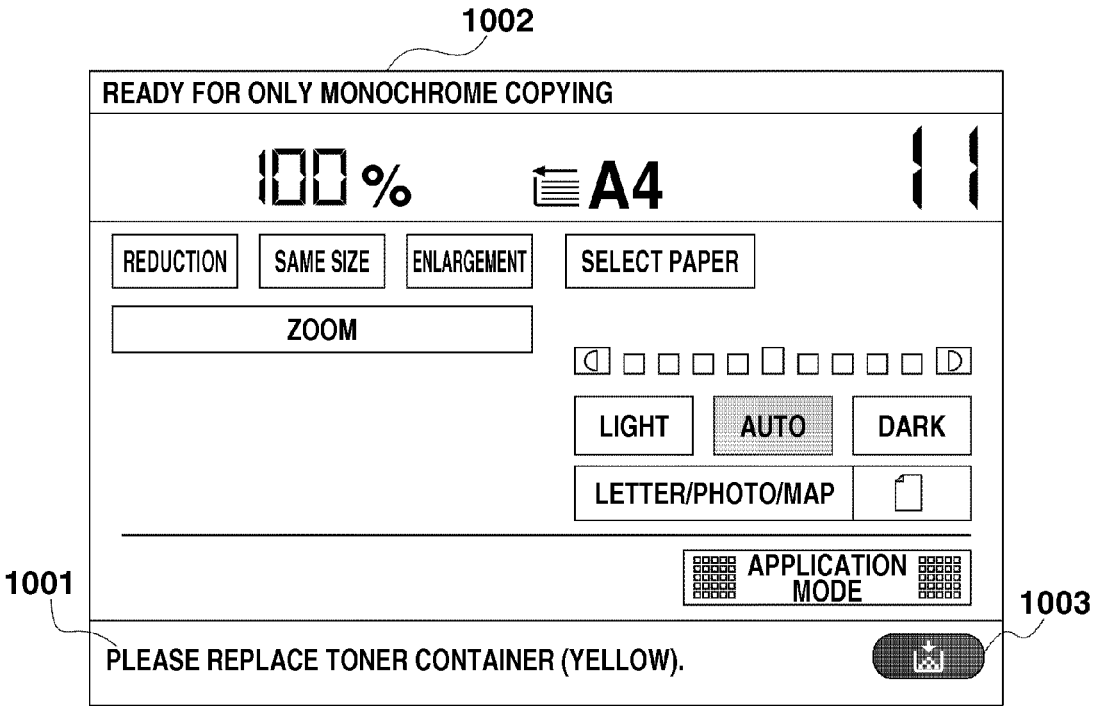
FIG. 10 is a diagram illustrating an example of a color toner empty warning screen displayed in the operation unit of the exemplary embodiment.

In step S801, when the main body of a color copying machine is turned on, the CPU 501 acquires the remaining amount of toner from the toner bottle internal toner remaining amount calculation unit 508, the hopper internal toner detection sensor 408, and the development device internal toner detection sensor 409 as shown in FIG. 5. Next, the processing proceeds to step S802 to check whether there is a remaining amount of toner in the development devices 14*a* to 14*d* with the development device internal toner detection sensor 409. If the CPU 501 determines that there is no remaining amount of toner in one of the development devices 14*a* to 14*d* (YES in step S802), the processing proceeds to step S803 to display, as illustrated in FIG. 10, a message 1001 of warning of no toner in the operation unit 600. Next, processing proceeds to step S804 to check whether there is black toner in the development device 14*a*. If the CPU 501 determines that there is no black toner (YES in step S804), the processing proceeds to step S805 to display, as illustrated in FIG. 9, a toner container replacement screen 901 in the operation unit 600. Now, the toner container replacement screen 901 will be described in detail.

FIG. 9 is a diagram illustrating a display example of the toner container replacement screen displayed in the operation unit of the exemplary embodiment. In FIG. 9, a "close" key 902 closes the toner container replacement screen 901 to stop replacement of a toner bottle. A replaceable toner container list 904 shows toner detected by the hopper internal toner detection sensor 408 and the development device internal toner detection sensor 409 that there is no remaining amount of toner in the toner bottle. Replaceable toner container list selection keys 905, 906, 907, and 908 switch the toner bottle and determines whether the toner bottle is to be replaced when pressed. An "extract toner container" key 909 unlocks the toner bottle cover corresponding to the toner bottle being checked.

Returning to FIG. 8, in step S805, after the toner container replacement screen 901 is displayed, the processing proceeds to step S813 to perform a toner container replacement process.

On the other hand, if the CPU 501 determines that there is black toner in the development device 14*a* in step S804 (NO in step S804), the processing proceeds to step S806 to display, as illustrated in FIG. 10, a message 1002 to permit only monochrome copying in the operation unit 600. In FIG. 10, a toner container replacement screen display key 1003 displays the toner container replacement screen 901 to start replacement of the toner bottle.

Returning to FIG. 8, in step S807, the CPU 501 checks whether the toner container replacement screen display key 1003 has been pressed. If the CPU 501 determines that the toner container replacement screen display key 1003 has been pressed (YES in step S807), the processing proceeds to step S805 to display the toner container replacement screen 901 in the operation unit 600. On the other hand, if the CPU 501 determines that the toner container replacement screen display key 1003 has not been pressed (NO in step S807), the processing proceeds to step S808 to check whether the toner replacement cover 220 has been opened through a toner replacement cover opening/closing detection sensor 504. If the CPU 501 determines that the toner replacement cover 220 has been opened (YES in step S808), the processing proceeds to step S805 to display the toner container replacement screen 901 in the operation unit 600. On the other hand, if the CPU 501 determines that the toner replacement cover 220 has not been opened (NO in step S808), the CPU 501 terminates the processing.

Figure 11:
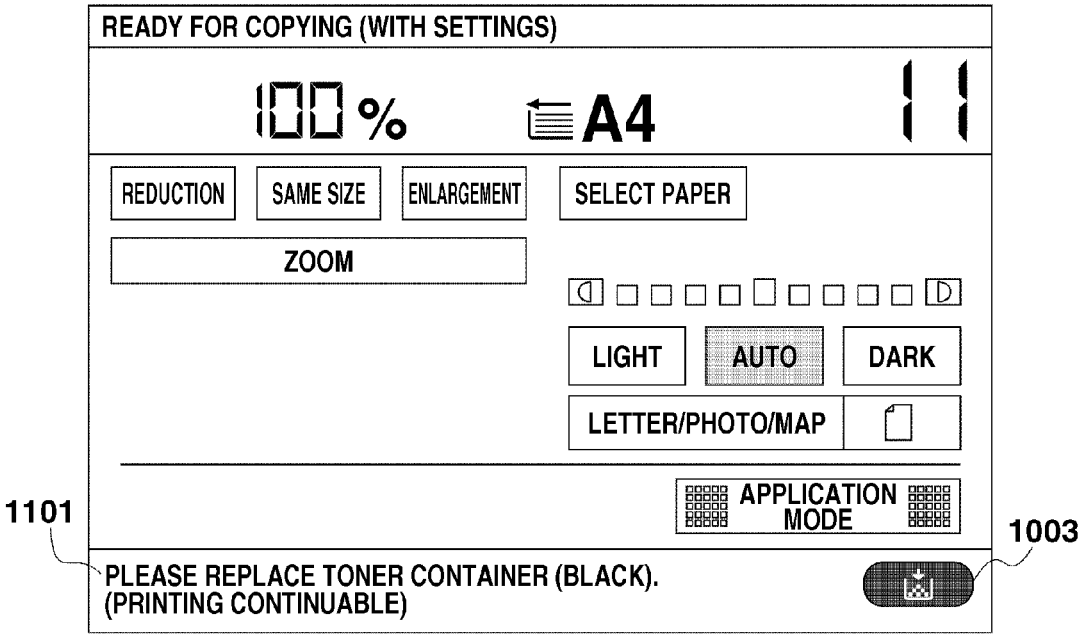
FIG. 11 is a diagram illustrating an example of a toner replaceability warning screen displayed in the operation unit of the exemplary embodiment.

If the CPU 501 determines that there is toner in the development devices 14*a* to 14*d* in step S802 (NO in step S802), the processing proceeds to step S809 to check whether there is a remaining amount of toner in the hopper 404, with the hopper internal toner detection sensor 408. If the CPU 501 determines that there is no toner in one hopper of the hopper 404 (YES in step S809), the processing proceeds to step S810 to display, as illustrated in FIG. 11, a message 1101 of toner replaceability warning in the operation unit 600 before proceeding to step S807.

Figure 12:
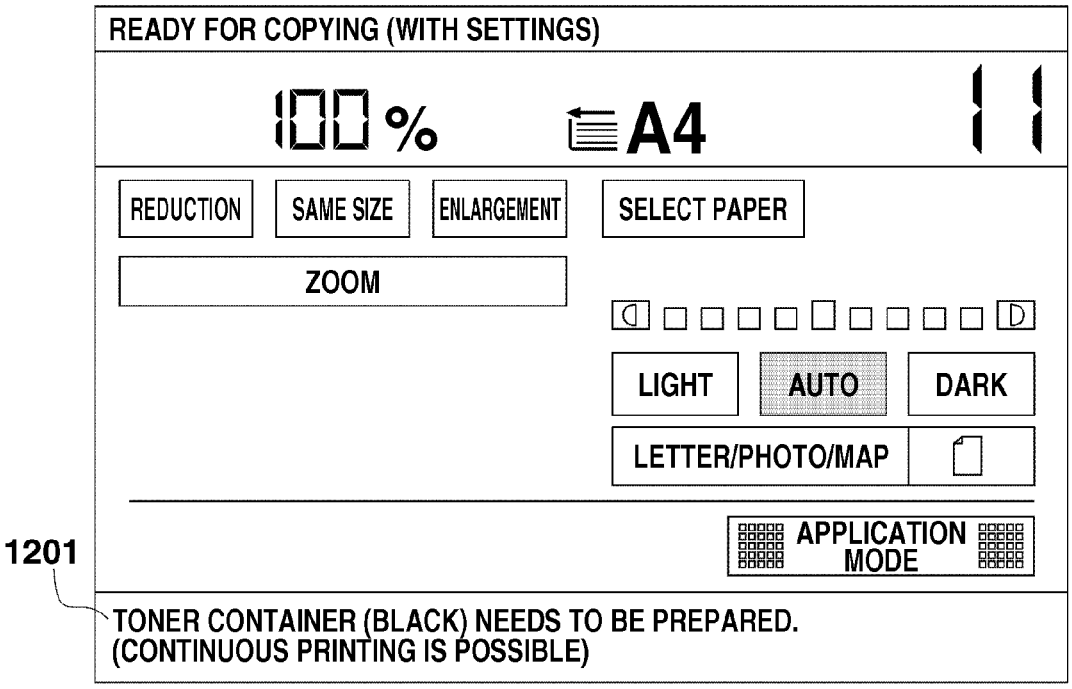
FIG. 12 is a diagram illustrating a display example of a remaining toner small amount warning screen displayed in the operation unit of the exemplary embodiment.

If the CPU 501 determines that there is toner in the hopper 404 in step S809 (NO in step S809), the processing proceeds to step S811 to check whether the remaining amount of toner in the toner bottle 301 is small with the toner bottle internal toner remaining amount calculation unit 508. If the CPU 501 determines that the remaining amount of toner in the toner bottle 301 is small in one toner bottle of the toner bottle 301*s* (YES in step S811), the processing proceeds to step S812 to display, as illustrated in FIG. 12, a message 1201 of toner remaining amount small warning in the operation unit 600 before terminating the processing. On the other hand, if the CPU 501 determines that the remaining amount of toner in the toner bottle 301*s* is not small in step S811 (NO in step S811), the CPU 501 terminates the processing.

Figure 13:
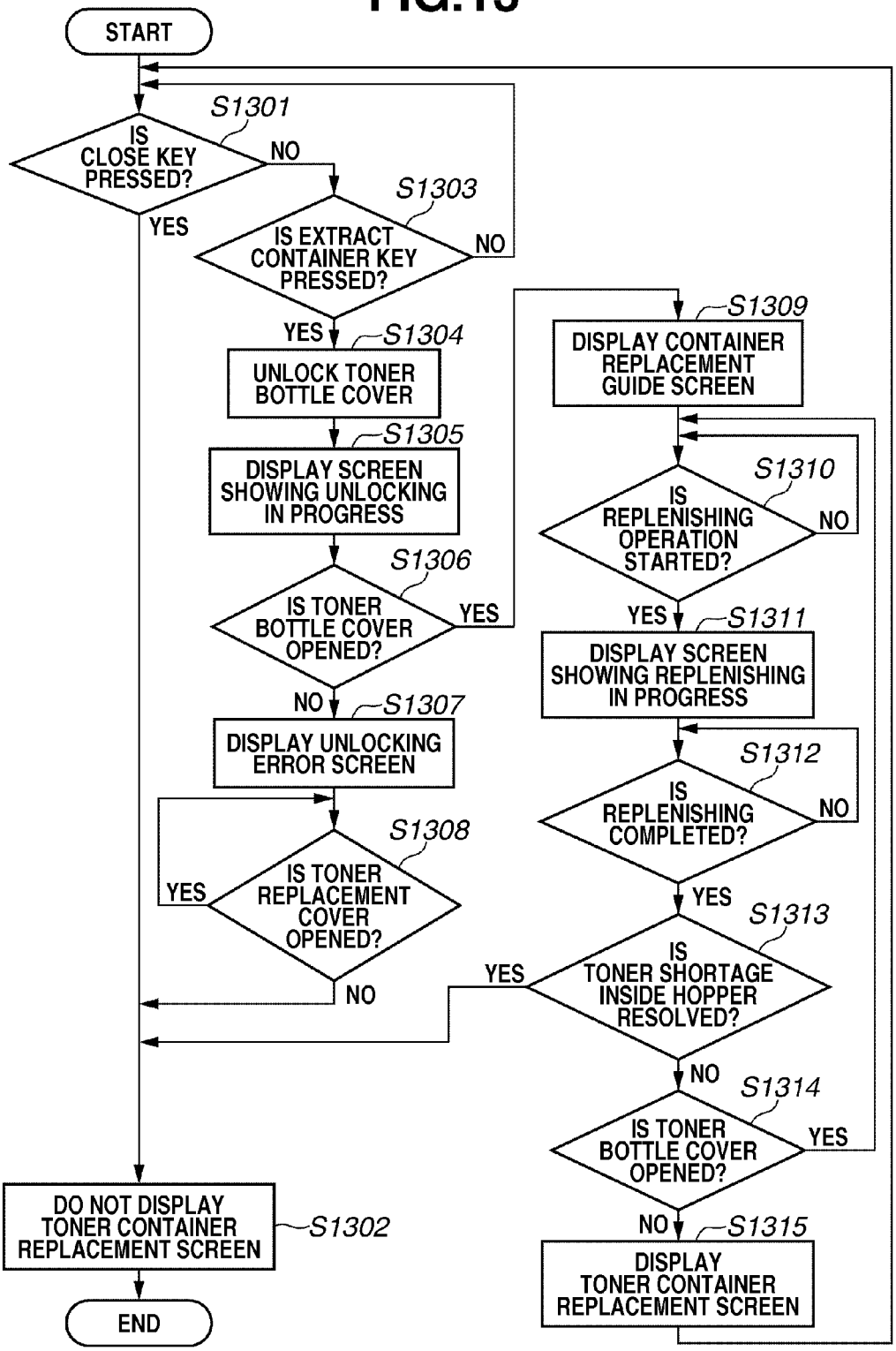
FIG. 13 is a flow chart illustrating the control procedure of a toner container replacement process in the exemplary embodiment.

Next, the control procedure for the toner container replacement process will be described using the flow chart in FIG. 13.

In step S1301, the CPU 501 checks whether the "close" key 902 in the toner container replacement screen 901 illustrated in FIG. 9 has been pressed. If the CPU 501 determines that the "close" key 902 has been pressed (YES in step S1301), the processing proceeds to step S1302 to hide the toner container replacement screen 901 before terminating the processing.

On the other hand, if the CPU 501 determines that the "close" key 902 has not been pressed in step S1301 (NO in step S1301), the processing proceeds to step S1303 to check whether the "extract toner container" key 909 described with reference to FIG. 9 has been pressed. If the CPU 501 determines that the "extract toner container" key 909 has not been pressed (NO in step S1303), the processing returns to step S1301. On the other hand, if the CPU 501 determines that the "extract toner container" key 909 has been pressed in step S1303 (YES in step S1303), the processing proceeds to step S1304.

Figure 14:
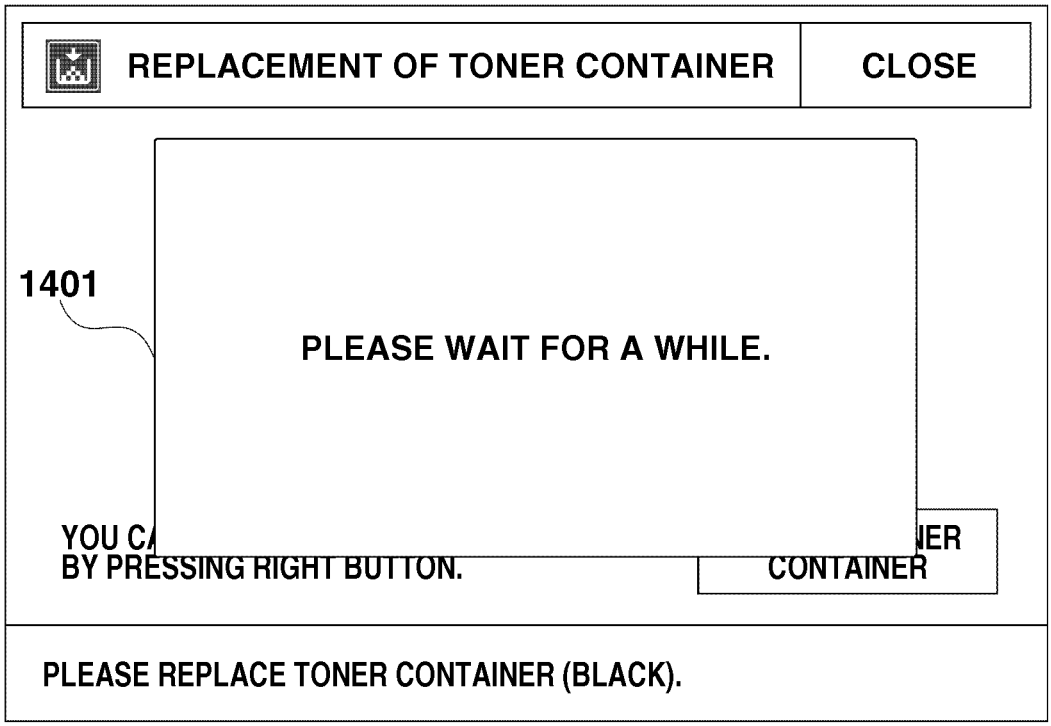
FIG. 14 is a diagram illustrating a display example of an unlocking execution screen displayed in the operation unit of the exemplary embodiment.

In step S1304, the CPU 501 unlocks toner bottle covers corresponding to the selected toner bottles by the keys 905 to 908 in the toner container replacement screen 901. Next, in step S1305, the CPU 501 displays, as illustrated in FIG. 14, an unlocking execution screen 1401 in the operation unit 600.

Figure 15:
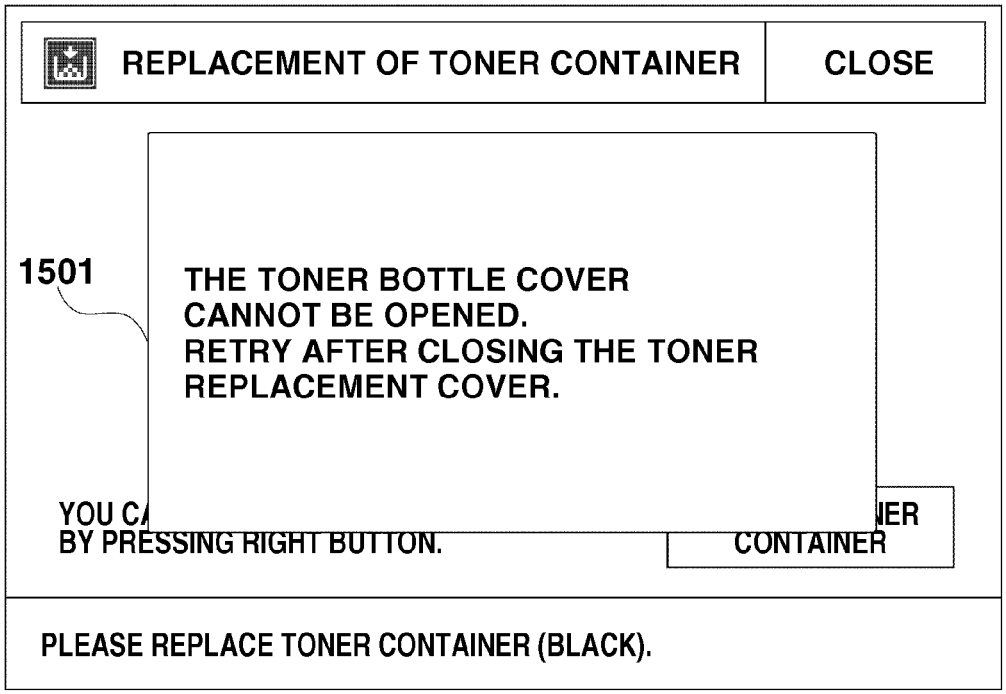
FIG. 15 is a diagram illustrating an example of an unlocking error screen displayed in the operation unit of the exemplary embodiment.

In step S1306, the CPU 501 checks whether all selected toner bottle covers have been opened through the toner bottle cover opening/closing detection sensor 406. If the CPU 501 determines that one of the toner bottle covers has not been opened (NO in step S1306), the processing proceeds to step S1307 to display, as illustrated in FIG. 15, an unlocking error screen 1501 in the operation unit 600. Next, the processing proceeds to step S1308 to continue monitoring until the toner replacement cover 220 is closed. If the CPU 501 determines that the toner replacement cover 220 has been closed (NO in step S1308), the processing proceeds to step S1302.

On the other hand, if the CPU 501 determines that all selected toner bottle covers have been opened in step S1306

Figure 16:
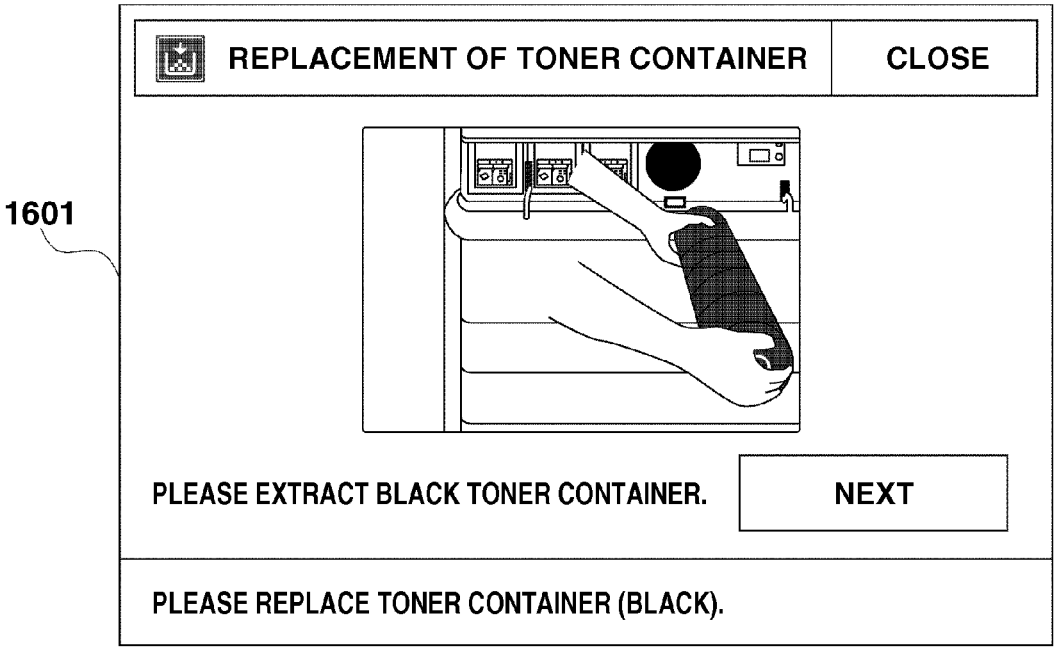
FIG. 16 is a diagram illustrating an example of a toner container replacement guide screen displayed in the operation unit of the exemplary embodiment.

(YES in step S1306), the processing proceeds to step S1309 to display, as illustrated in FIG. 16, a replacement guide screen 1601 to notify the operation unit 600 of the replacement procedure of a toner container.

Figure 17:
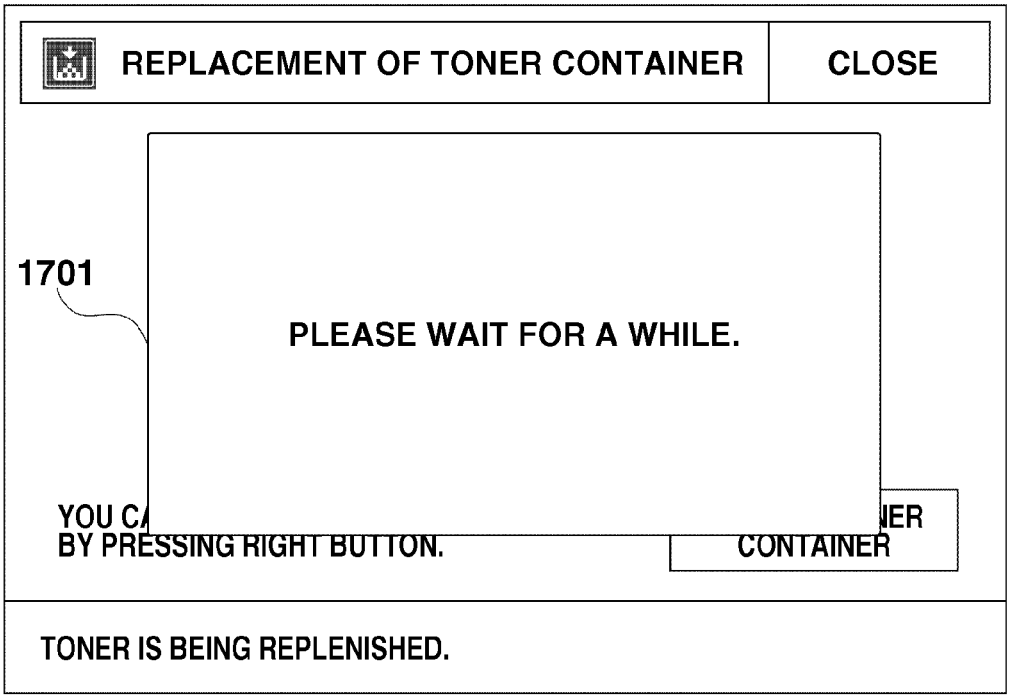
FIG. 17 is a diagram illustrating an example of a toner replenishing execution screen displayed in the operation unit of the exemplary embodiment.

In step S1310, the CPU 501 continues monitoring until a toner replenishing operation starts. The toner replenishing operation is performed simultaneously with a closure of the toner bottle covers 222 to 224. If the CPU 501 determines that the toner replenishing operation has started (YES in step S1310), the processing proceeds to step S1312 to display, as illustrated in FIG. 17, a toner replenishing execution screen in the operation unit 600. Next, the processing proceeds to step S1313 to continue monitoring until the toner replenishing operation is completed. If the CPU 501 determines that the toner replenishing operation has completed (YES in step S1312), the processing proceeds to step S1313 to check whether an error of no toner in the hopper has been eliminated through the hopper internal toner detection sensor 408. If the CPU 501 determines that the error of no toner in the hopper has been eliminated (YES in step S1313), the processing proceeds to step S1302 to terminate the toner container replacement process.

On the other hand, if the CPU 501 determines that the error of no toner in the hopper has not been eliminated in step S1313 (NO in step S1313), the processing proceeds to step S1314. In step S1314, the CPU 501 checks whether the toner bottle cover corresponding to the toner bottle whose error has not been eliminated is opened with the toner bottle cover opening/closing detection sensor 406. If the CPU 501 determines that the toner bottle cover corresponding to the toner bottle whose error has not been eliminated is opened (YES in step S1314), the processing returns to step S1310. On the other hand, if the CPU 501 determines that the toner bottle cover corresponding to the toner bottle whose error has not been eliminated is not opened in step S1314 (NO in step S1314), the processing proceeds to step S1315 to display the toner container replacement screen 901 in the operation unit 600 before returning to step S1301.

According to the present invention, as described above, if no toner is detected inside the hopper 404, an instruction for unlocking of the toner bottle cover 221 corresponding to the toner bottle 301 is issued from the toner container replacement screen 901 displayed in the operation unit 600. Accordingly, the toner bottle 301 can be made replaceable after toner in the toner bottle 301 is reliably used up.

Also, according to the present invention, the cover corresponding to at least one toner container is unlocked at a time and therefore, at least one toner container can be replaced at a time, reducing the time necessary for toner replacement. Further, the toner container to be unlocked is selected from at least one toner container in the toner container replacement screen and therefore, only the toner container desired by the user can be replaced, which improves operability of toner container replacement.

Also, according to the present invention, when opening of covers of toner container is detected and at least one cover is not opened, the user is notified to retry toner replacement. Accordingly, the user can be notified of a solution when an error occurs, which improves operability of toner container replacement.

Further, according to the present invention, when black toner is not detected, the toner container replacement screen is forcibly displayed and therefore, the user can be swiftly prompted to replace the toner container, which reduces downtime of the image forming apparatus.

Other Embodiments

Aspects of the present invention can also be realized by a computer of a system or apparatus (or devices such as a CPU or a micro-processing unit (MPU)) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., non-transitory computer-readable storage medium). The program includes computer-executable instructions for implementing the present invention.

An operating system (OS) or other application software running on a computer can execute part or all of actual processing based on instructions of the program to realize the functions one or more of the above-described exemplary embodiments.

Additionally, the program read out of a storage medium can be written into a memory of a function expansion card inserted in a computer or into a memory of a function expansion unit connected to the computer. In this case, based on instructions of the program, a CPU or MPU provided on the function expansion card or the function expansion unit can execute part or all of the processing to realize the functions of one or more of the above-described exemplary embodiments.

A wide variety of storage media may be used to store the program. The storage medium may be, for example, any of a flexible disk (floppy disk), a hard disk, an optical disk, a magneto-optical disk, a compact disc (CD), a digital versatile disc (DVD), a read only memory (ROM), a CD-recordable (R), a CD-rewritable, a DVD-recordable, a DVD-rewritable, a magnetic tape, a nonvolatile memory card, a flash memory device, and so forth.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-153320 filed Jun. 29, 2009, which is hereby incorporated by reference herein in its entirety.

What is claimed is:

1. An image forming apparatus from which toner container containers of a plurality of colors and a black toner are detachable, including a development device to which toner in the toner container is fed and in which the toner used for image formation is accumulated, and a display, comprising:

a locking unit configured to lock a cover of each of the toner containers so that the mounted toner container is not extracted;

a detection unit configured to detect that there is no toner in the mounted toner container; and a display unit configured, when the detection unit detects that there is no toner, to cause the display to display a replacement screen to receive input for replacing the toner container in which no toner is detected;

wherein, in a case where the detection unit detects that the toner container of the black toner contains no toner, the display unit displays the replacement screen to prompt replacement of the toner container of the black toner and, in response to the input received via the screen displayed by the display unit to make replaceable the toner container in which no toner is detected, the locking unit unlocks the cover of the toner container of the black toner, and wherein in a case where the detection unit detects that the toner container of a color toner contains no toner but does not detect that the toner container of the black toner contains no toner, the display unit does not display the replacement screen until an input for displaying the replacement screen by a user is received.

2. The image forming apparatus according to claim 1, wherein the user's instruction is given by a key operation to display the screen so that the input to replace the toner container is received.

3. The image forming apparatus according to claim 1, further comprising toner replacement covers outside the covers of a plurality of toner containers, wherein the user's instruction is detection that the toner container cover has been opened.

4. The image forming apparatus according to claim 1, wherein the detection unit detects that, when it is detected that the development device contains no toner, the mounted toner container has no toner.

5. The image forming apparatus according to claim 1, further comprising a hopper to feed the toner from the toner container to the development device, wherein when it is detected that the hopper contains no toner, the detection unit detects that the mounted toner container contains no toner.

6. The image forming apparatus according to claim 1, wherein from among a plurality of the toner containers that contain no toner according to the detection by the detection unit, a toner container to be replaced can be selected in the screen displayed by the display unit, and wherein the cover of the toner container selected from the screen is unlocked by the locking unit in response to the input received via the screen displayed by the display unit to make replaceable the selected toner container.

7. The image forming apparatus according to claim 1, wherein if the cover of the toner container will not open when the locking unit unlocks the cover of the toner container, an error is notified via the display.

8. The image forming apparatus according to claim 1, wherein if the cover of the toner container will open when the cover of the toner container is unlocked by the locking unit, a replacement procedure is notified via the display.

9. The image forming apparatus according to claim 1, wherein the toner container is replaced after the cover of the toner container is unlocked, and wherein the toner is fed from the toner container to the development device in response to closing of the cover of the toner container.

10. A method for an image forming apparatus from which toner containers of a plurality of colors and a black toner are detachable, including a development device to which toner in the toner container is fed and in which the toner used for image formation is accumulated, and a display, comprising:

locking a cover of each of the toner containers so that the mounted toner container is not extracted;

detecting that there is no toner in the mounted toner container;

when it is detected that there is no toner, causing the display to display a replacement screen to receive input for replacing the toner container in which no toner is detected;

in a case where the detecting detects that the toner container of the black toner contains no toner, displaying the replacement screen to prompt replacement of the toner container of the black toner and, in response to the input received via the displayed screen to make replaceable the toner container in which no toner is detected, unlocking the cover of the toner container of the black toner, and in a case where the detecting detects that the toner container of a color toner contains no toner but does not detect that the toner container of the black toner contains no toner, not displaying the replacement screen until an input for displaying the replacement screen by a user is received.

11. A non-transitory computer readable storage medium on which is stored a computer program for making a computer execute a method for controlling an image forming apparatus from which toner containers of a plurality of colors and a black toner are detachable, the image forming apparatus including a development device to which toner of a detachable toner container is fed and in which the toner used for image formation is accumulated, and a display, the method comprising:

locking a cover of each of the toner containers so that the mounted toner container is not extracted;

detecting that there is no toner in the mounted toner container;

when it is detected that there is no toner, causing the display to display a replacement screen to receive input for replacing the toner container in which no toner is detected;

in a case where the detecting detects that the toner container of the black toner contains no toner, displaying the replacement screen to prompt replacement of the toner container of the black toner and, in response to the input received via the displayed screen to make replaceable the toner container in which no toner is detected, unlocking the cover of the toner container of the black toner, and in a case where the detecting detects that the toner container of a color toner contains no toner but does not detect that the toner container of the black toner contains no toner, not displaying the replacement screen until an input for displaying the replacement screen by a user is received.

* * * * *